US009428973B2

(12) United States Patent
Park

(10) Patent No.: US 9,428,973 B2
(45) Date of Patent: Aug. 30, 2016

(54) QUICK-RELEASE GRIPPING INSERT ASSEMBLY

(71) Applicant: PREMIER COIL SOLUTIONS, Houston, TX (US)

(72) Inventor: Do Seo Park, Houston, TX (US)

(73) Assignee: Premier Coil Solutions, Inc., Waller, TX (US)

( * ) Notice: Subject to any disclaimer, the term of this patent is extended or adjusted under 35 U.S.C. 154(b) by 260 days.

(21) Appl. No.: 14/272,319

(22) Filed: May 7, 2014

(65) Prior Publication Data

US 2014/0332236 A1 Nov. 13, 2014

Related U.S. Application Data

(60) Provisional application No. 61/820,440, filed on May 7, 2013.

(51) Int. Cl.
*E21B 19/22* (2006.01)
*B66D 3/00* (2006.01)

(52) U.S. Cl.
CPC ..... *E21B 19/22* (2013.01); *B66D 3/003* (2013.01)

(58) Field of Classification Search
CPC ..... E21B 19/22
USPC ..... 166/77.3; 226/173
See application file for complete search history.

(56) References Cited

U.S. PATENT DOCUMENTS 3,285,485 A * 11/1966 Slator ..... E21B 19/22 166/77.3
3,351,034 A * 11/1967 Grek ..... B21C 37/0807 226/173
4,787,505 A * 11/1988 Tweedy ..... B65G 17/32 198/803.11
5,309,990 A 5/1994 Lance
5,839,636 A * 11/1998 Fleischmann ..... H02G 1/10 226/172
5,975,203 A * 11/1999 Payne ..... E21B 19/22 166/77.1
6,173,769 B1 1/2001 Goode
6,189,609 B1 2/2001 Shaaban et al.
6,209,634 B1 4/2001 Avakov et al.
6,230,955 B1 5/2001 Parks
6,332,501 B1 12/2001 Gipson
6,408,955 B2 * 6/2002 Gipson ..... E21B 19/22 166/384
6,892,810 B2 5/2005 Austbo et al.
8,132,617 B2 3/2012 Magnus
RE43,410 E 5/2012 Goode
8,191,620 B2 6/2012 Maschek et al.
2010/0132935 A1 * 6/2010 Magnus ..... E21B 19/22 166/77.3
2011/0048694 A1 * 3/2011 Maschek, Jr. ..... E21B 19/22 166/77.3
2015/0167405 A1 * 6/2015 Hickey ..... E21B 19/22 166/379

FOREIGN PATENT DOCUMENTS

EP 0486324 5/1992
EP 1036747 9/2000
GB 2325948 12/1998

* cited by examiner

*Primary Examiner* — Shane Bomar
(74) *Attorney, Agent, or Firm* — Lloyd L. Davis; Andrews Kurth LLP

(57) ABSTRACT

A coiled tubing injector unit insert assembly includes a gripping insert configured to be coupled to a carrier block, the insert comprising a tongue with a first cutout configured to engage a shaft extending within a carrier block pocket, the shaft having a first diameter portion and a second larger diameter portion and a junction between the two shaft diameters that is located within the carrier block pocket to couple the gripping insert to the carrier block.

18 Claims, 10 Drawing Sheets

QUICK-RELEASE GRIPPING INSERT ASSEMBLY

CROSS-REFERENCE TO RELATED APPLICATIONS

This application claims priority under 35 U.S.C. §119(e) to U.S. Provisional Application No. 61/820,440 filed May 7, 2013, which is incorporated herein by reference in its entirety.

FIELD

This invention relates to coiled tubing injector units. More particularly, this invention relates to gripping insert assemblies for coiled tubing injector units.

BACKGROUND AND SUMMARY

In the oil and gas industries, coiled tubing refers to metal piping used for interventions in oil and gas wells and sometimes as production tubing in depleted gas wells. Available in sizes ranging from 1 inch to 4.5 inches, coiled tubing strings are carried on reels and injected into a wellbore using a coiled tubing injector unit. A typical coiled tubing injector unit 5 is illustrated in FIG. 1. The typical unit includes a goose-neck support 3, a rotary transmission assembly, parallel drive chains 7 carrying gripping insert assemblies, skates and a hydraulic system. (The transmission assembly, gripping insert assemblies, skates and hydraulic system are not shown in detail in FIG. 1). Those skilled in the art are familiar with the components and operation of the unit 5 illustrated in FIG. 1.

The series of gripping insert assemblies carried by the chains provide the sole direct support for holding the coiled tubing in place or moving the tubing. The gripping insert assemblies are arranged in opposing pairs to secure the coiled tubing string between the injector-head chains. The hydraulic system applies pressure to the skates which in turn force the gripping insert assemblies toward each other thereby securing the coiled tubing between the gripping insert assemblies. Additionally, the hydraulic drive system drives the chains to feed the coiled tubing string into the well or pull the tubing out of the well.

A typical gripping insert assembly includes a carrier block secured to the drive chain and a gripping insert supported by the carrier block. From time to time, the gripping insert must be replaced due to damage or wear or to accommodate a change in tubing diameter or insertion of a downhole tool. Thus, a need exists for a gripping insert assembly which permits quick replacement of the gripping insert.

In one aspect, embodiments disclosed herein relate to a coiled tubing injector unit insert assembly including a gripping insert configured to be coupled to a carrier block, the insert comprising a tongue with a first cutout configured to engage a shaft extending within a carrier block pocket, the shaft having a first diameter portion and a second larger diameter portion and a junction between the two shaft diameters that is located within the carrier block pocket to couple the gripping insert to the carrier block.

In other aspects, embodiments disclosed herein relate to a coiled tubing conveying apparatus including a pair of continuous parallel drive chains revolving in a common plane, said pair of continuous drive chains having opposed, elongated parallel runs spaced apart to form a path for engaging tubing passing there through, and a plurality of gripping insert assemblies carried on each of said pair of continuous drive chains, each comprising a gripping insert configured to be coupled to a carrier block, the insert comprising a tongue with a first cutout configured to engage a shaft extending within a carrier block pocket, the shaft having a first diameter portion and a second larger diameter portion and a junction between the two shaft diameters that is located within the carrier block pocket to couple the gripping insert to the carrier block.

In yet other aspects, embodiments disclosed herein relate to a method of assembling a coiled tubing injector unit insert assembly including providing a gripping insert configured to be coupled to a carrier block, the insert comprising a tongue with a first cutout configured to engage a shaft extending within a carrier block pocket, the shaft having a first diameter portion and a second larger diameter portion and a junction between the two shaft diameters that is located within the carrier block pocket to couple the gripping insert to the carrier block, inserting the gripping insert tongue into the carrier block pocket until the first cutout is substantially concentrically aligned with the larger shaft diameter portion, and sliding the gripping insert in a first direction and causing the first cutout in the tongue to engage the larger shaft diameter portion, thereby coupling the gripping insert to the carrier block.

BRIEF DESCRIPTION OF THE DRAWINGS

The invention is illustrated in the accompanying drawings wherein.

DETAILED DESCRIPTION

Figure 1:
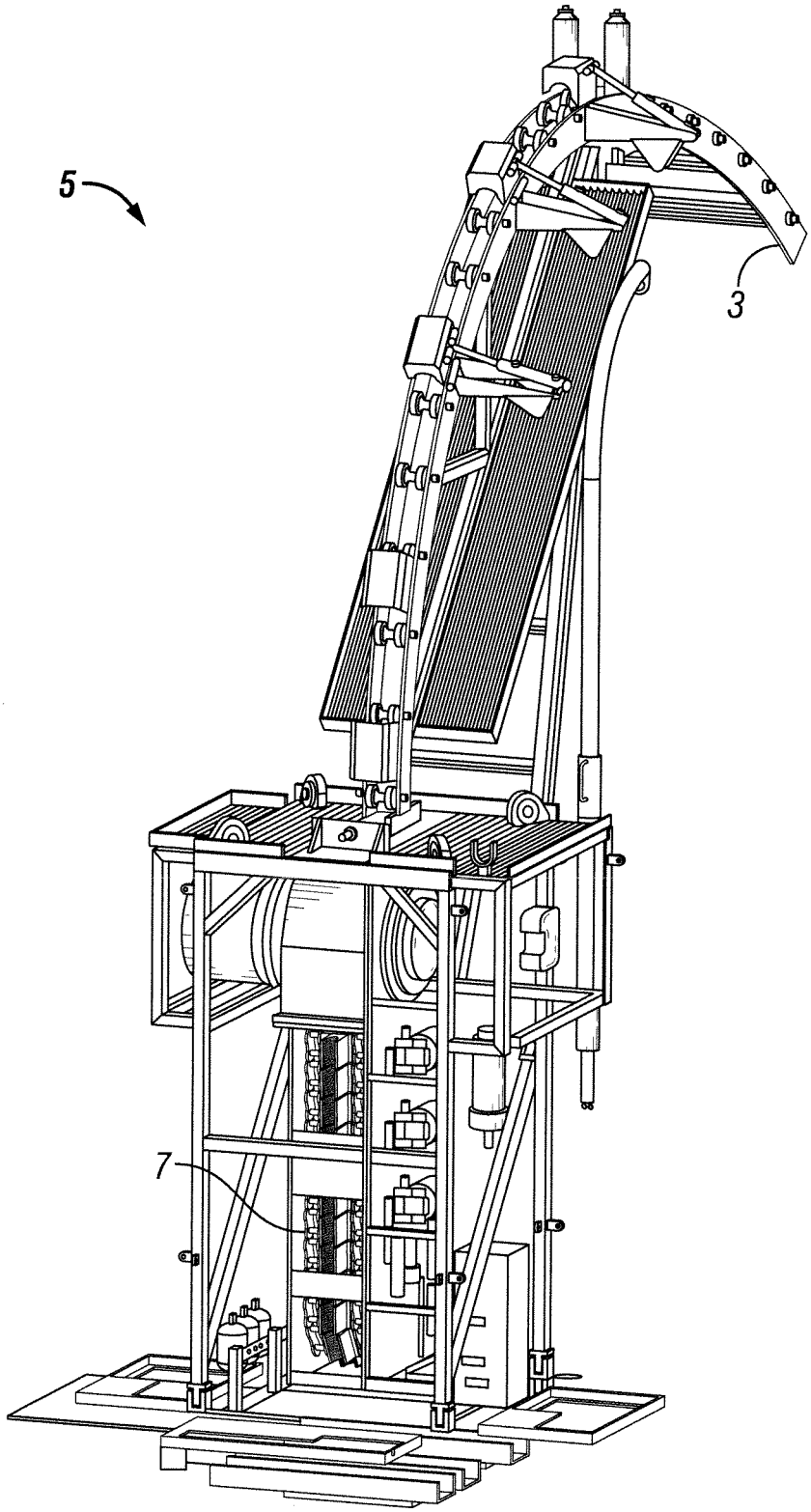
FIG. 1 is a perspective view of a coiled tubing injector unit.

The aspects, features, and advantages of the invention mentioned above are described in more detail by reference to the drawings, wherein like reference numerals represent like elements. As used herein, "longitudinal" or "longitudinally" means of or relating to length or running lengthwise. As used herein, "latitudinal" or "latitudinally" means of or relating to width or running widthwise.

Figure 2:
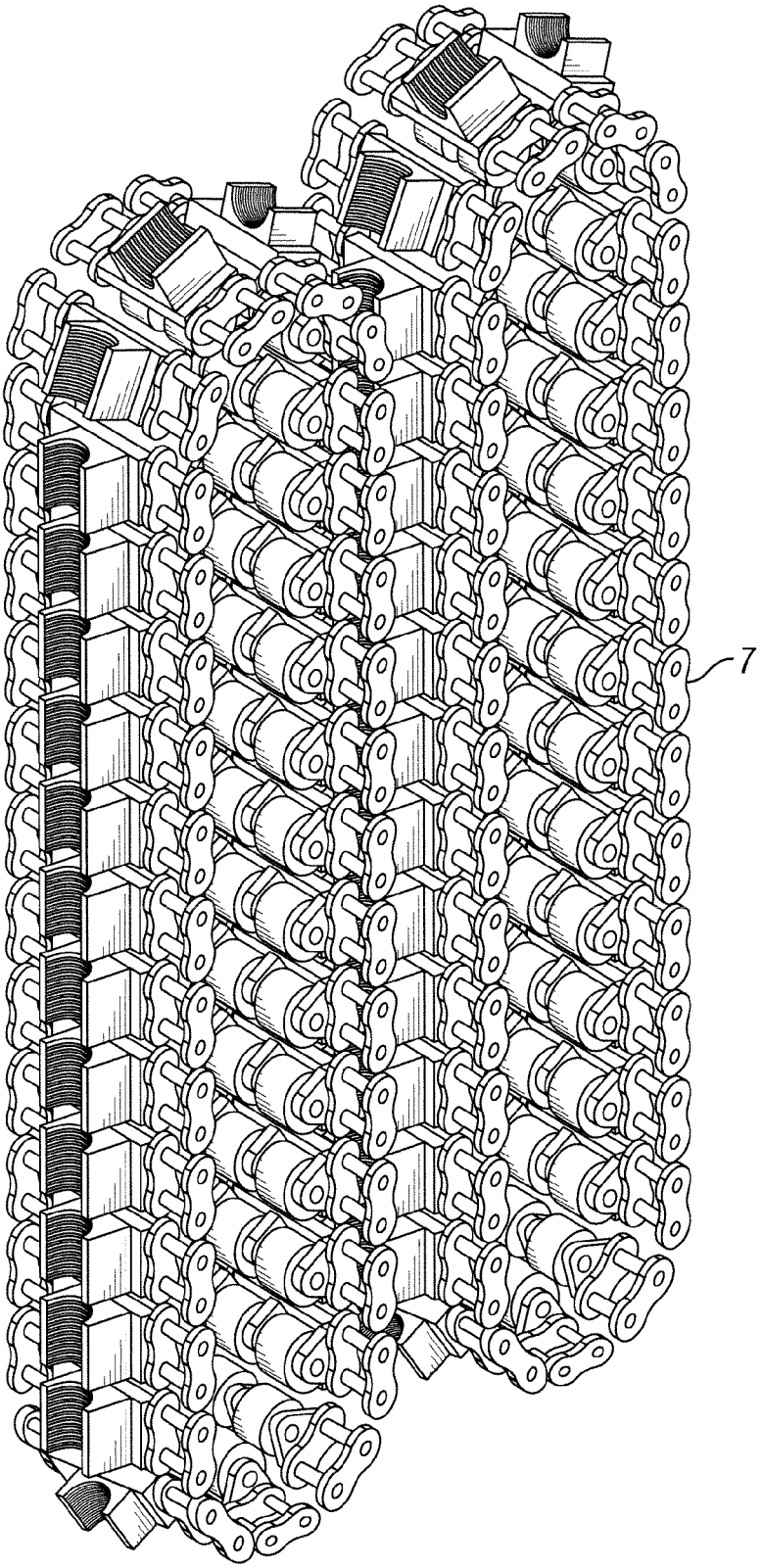
FIG. 2 illustrates a drive chain assembly component of FIG. 1.

A quick-release gripping insert assembly suitable for use in a conventional coiled tubing injector unit 5 to grasp and hold coiled tubing is disclosed. FIG. 2 illustrates a conventional drive chain 7 of coiled tubing injector unit 5 having quick-release gripping insert assemblies attached. A pair of continuous parallel drive chains 7 revolve in a common plane and have opposed, elongated parallel runs spaced apart to form a path for engaging tubing passing there through. With reference to FIGS. 3A-D, the quick-release gripping insert assembly 100 includes a carrier block 110 secured to the drive chain 7, a gripping insert 140 coupled to the carrier block 110 with a shaft 170 and locked in place on the carrier block 110 with a spring plunger 190. The gripping insert 140, carrier block 110 and shaft 170 may be steel, or other suitable materials known to one of ordinary skill in the art.

Figure 4A:
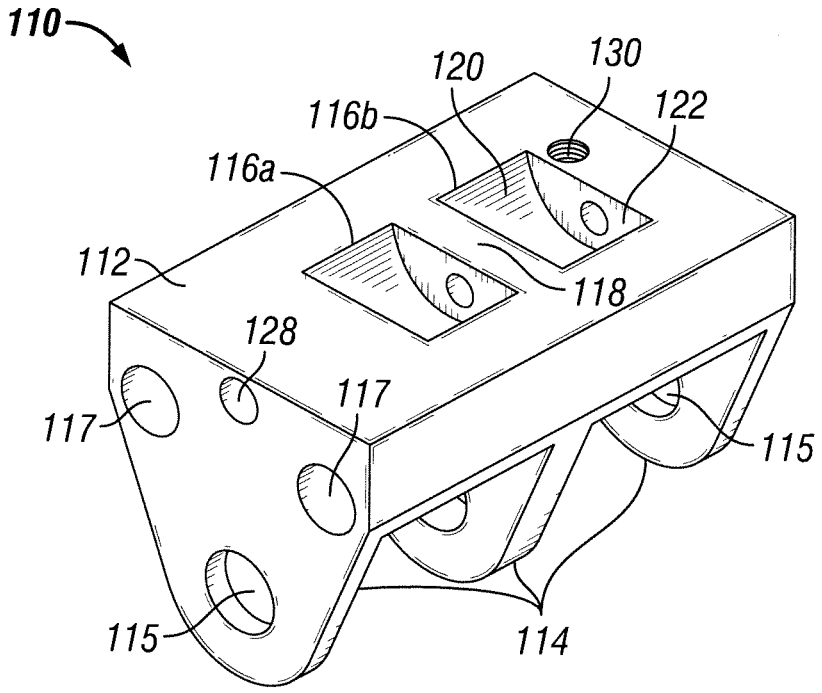
FIGS. 4A-B illustrate a carrier block of the gripping insert assembly shown in FIGS. 3A-D.
Figure 4B:
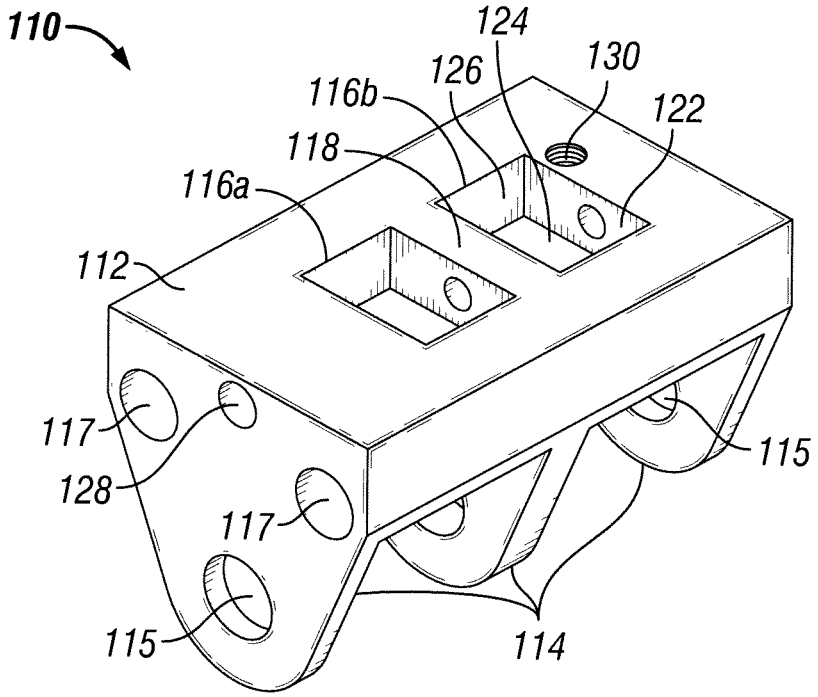

Referring now to FIGS. 4A-B, perspective views of a carrier block 110 in accordance with one or more embodiments of the present disclosure are shown. The carrier block 110 may be formed as an integral component having an upper surface 112 and extruded tongue portions 114 extending from an opposite side of the carrier block 110 and away from the upper surface 112. In certain embodiments, the upper surface 112 may be substantially planar. Alternatively, the upper surface 112 of the carrier block may be curvilinear or curved, either latitudinally, longitudinally, or both. For example, a curved upper surface may be convex or concave. The extruded tongue portions 114 have longitudinally aligned openings 115 through which roller bearings may be installed to ride on a skate plate (not shown) of the injector head. Additionally, the carrier block 110 includes one or more circular channels 117 through which one or more pins may be installed for securing the carrier block 110 to the drive chain 7.

One or more pockets 116*a*, 116*b* may be formed in the upper planar surface 112 of the carrier block 110. The pockets 116*a*, 116*b* may be machined (e.g., using computer numerical control ("CNC")) or integrally co-formed with the carrier block 110 (e.g., by forging or casting processes). The pockets 116*a*, 116*b* may be separated by a divider wall 118 there between. While two pockets are illustrated, in other embodiments the carrier block 110 may have a single pocket formed therein, while in still other embodiments the carrier block 110 may have more than two pockets formed therein (e.g., three or more).

The pockets 116*a*, 116*b* may be generally rectangular or square-shaped in a top view, although other geometries are possible as will be understood by one of ordinary skill in the art. Illustrated in FIG. 4A, in certain embodiments, the pockets 116*a*, 116*b* may have a curved lower surface 120 which extends latitudinally and intersects the upper surface 112 at both ends of the pockets 116*a*, 116*b*. Longitudinally, the pockets 116*a*, 116*b* may be defined by two opposed end surfaces 122. The end surfaces 122 may be substantially vertical opposing surfaces that extend downward from the upper surface 112 and intersect the lower curved surface 120. In certain embodiments, intersections between the two end surfaces 122 and the curved bottom surface 120 may be beveled or rounded.

Illustrated in FIG. 4B, in other embodiments, the pockets 116*a*, 116*b* may have a substantially flat lower surface 124. Two opposed end surfaces 122 and two opposed side surfaces 126 may extend downward from the upper surface 112 to the substantially flat lower surface 124. In certain embodiments, the two end surfaces 122 and two side surfaces 126 may be angled (i.e., relative to the upper surface 112 and flat lower surface 124). In other embodiments, the two end surfaces 122 and two side surfaces 126 may be substantially vertical (i.e., perpendicular to the upper surface 112 and flat lower surface 124). In yet other embodiments, intersections between the two end surfaces 122, the two side surfaces 126, and the bottom flat surface 124 may be beveled or rounded.

Referring to both FIGS. 4A-B, the carrier block 110 has a latitudinally centrally located passageway 128 that extends longitudinally from end to end through the carrier block 110. The passageway 128 is positioned to extend longitudinally through both pockets 116*a*, 116*b*. Further, the carrier block 110 includes a threaded port 130 in the upper surface 112 of the carrier block 110. The threaded port 130 may be machined and threaded in the carrier block 110. The threaded port 130 is located proximate to at least one of the pockets 116*a*, 116*b* for reasons that will be described in detail below. The threaded port 130 extends downward into the carrier block 110 from the upper surface 112.

Figure 5A:
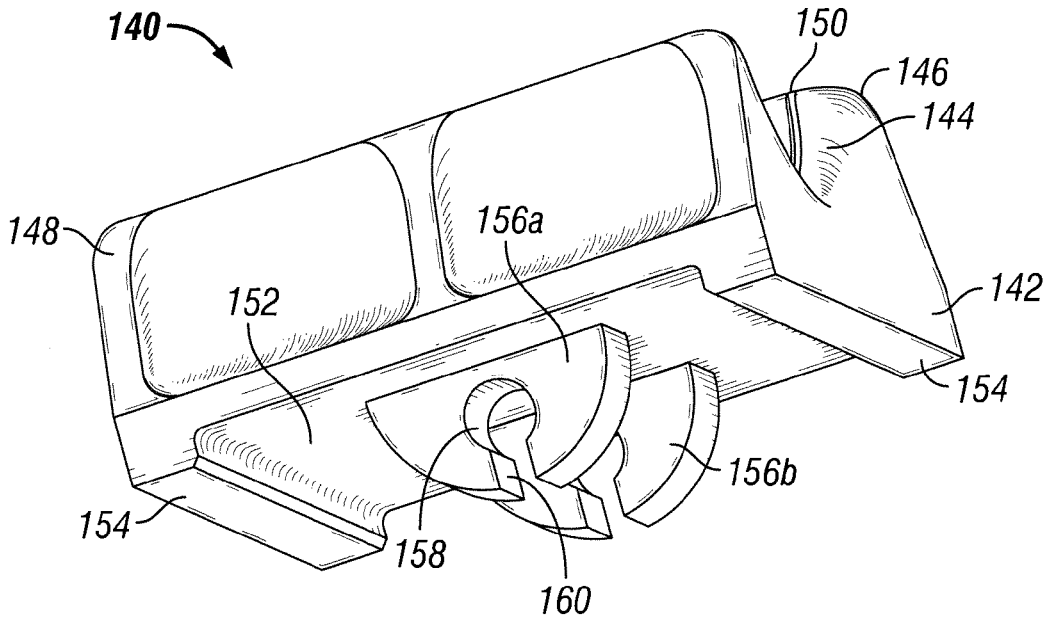
FIGS. 5A-B illustrate a gripping insert of the gripping insert assembly shown in FIGS. 3A-D.
Figure 5B:
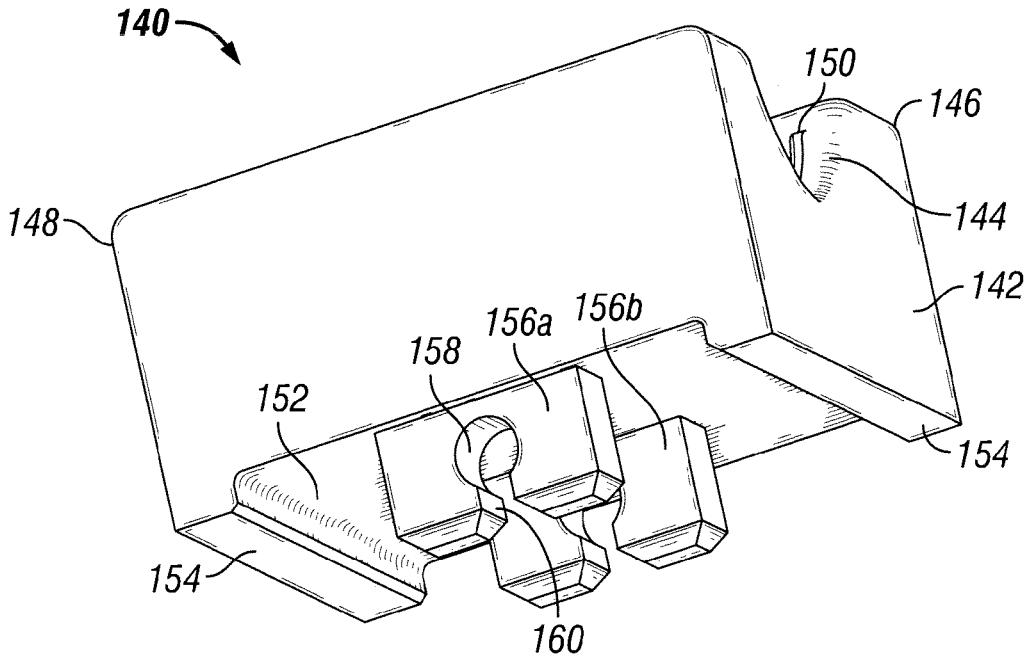

Referring now to FIGS. 5A-B, perspective views of a gripping insert 140 in accordance with one or more embodiments of the present disclosure are shown. The gripping insert 140 may be formed as an integral component with an upper portion 142 of the gripping insert 140 having a channel 144 that extends in a longitudinal direction fully across the gripping insert 140 and is open at a first end 146 and a second end 148 of the gripping insert 140. The channel 144 may be arranged and designed to grip coiled tubing. The channel 144 may be circular or may have angled flat surfaces. As shown, the channel 144 may have a plurality of transverse grooves 150 spaced longitudinally from the first end 146 to the second end 148 of the gripping insert 140.

The gripping insert 140 has a lower surface 152 that is arranged and designed to contact the upper surface (112 in FIGS. 4A-B) of the carrier block 110 when the gripping insert is installed on the carrier block 110, as will be described in more detail below. In certain embodiments, the lower surface 152 may be substantially planar corresponding to a substantially planar surface of the carrier block. Alternatively, the lower surface 152 of the gripping insert may be curvilinear or curved, either latitudinally, longitudinally, or both corresponding to a curvilinear or curved surface of the carrier block. For example, a curved lower surface may be convex or concave. Further, latitudinal lips 154 on a first end 146 and second end 148 of the gripping insert 140 may extend downward from the lower surface 152 away from the upper portion 142 of the gripping insert 140. The latitudinal lips 154 are arranged and designed to extend downward past the upper surface (112 in FIGS. 4A-B) of the carrier block 110 when the gripping insert 140 is installed on the carrier block 110.

Further, the gripping insert 140 includes one or more extruded tongue portions 156*a*, 156*b* that extend downward from the lower surface 152 away from the upper portion 142. The extruded tongues 156*a*, 156*b* may be longitudinally positioned on the lower surface 152 of the gripping insert 140. In certain embodiments, the extruded tongue portions 156*a*, 156*b* may be formed integrally with the upper portion 142. In other embodiments, the extruded tongue portions 156*a*, 156*b* may be welded to the lower surface 152 of the gripping insert 140. The one or more extruded tongue portions 156*a*, 156*b* are arranged and designed to correspond with and engage the one or more pockets 116*a*, 116*b* formed in the upper surface 112 of the carrier block 110, as will be described below in more detail. The extruded tongue portions 156*a*, 156*b* may be arranged and designed having a thickness in the latitudinal direction that is substantially equal to half of a distance between end surfaces 122 of pockets 116*a*, 116*b*. In alternative embodiments, the extruded tongue portions 156*a*, 156*b* may have any latitudinal thickness. The extruded tongue portions 156*a*, 156*b* may be longitudinally located at a central portion of the lower surface 152 of the gripping insert 140.

As illustrated in FIG. 5A, in certain embodiments, the extruded tongue portions 156*a*, 156*b* may have a semi-circular cross-section (longitudinally), which corresponds with a geometry of the pockets 116 in the carrier block 110 having a lower curved surface 120 (shown in FIG. 4A). As illustrated in FIG. 5B, in other embodiments, the extruded tongue portions 156*a*, 156*b* may have a square-like or rectangular cross-section (longitudinally), which corresponds with a geometry of pockets 116 in the carrier block 110 having a flat bottom surface 124 (shown in FIG. 4B). Other corresponding tongue and pocket configurations and geometries are also possible and will be understood by one of ordinary skill in the art.

Figure 5C:
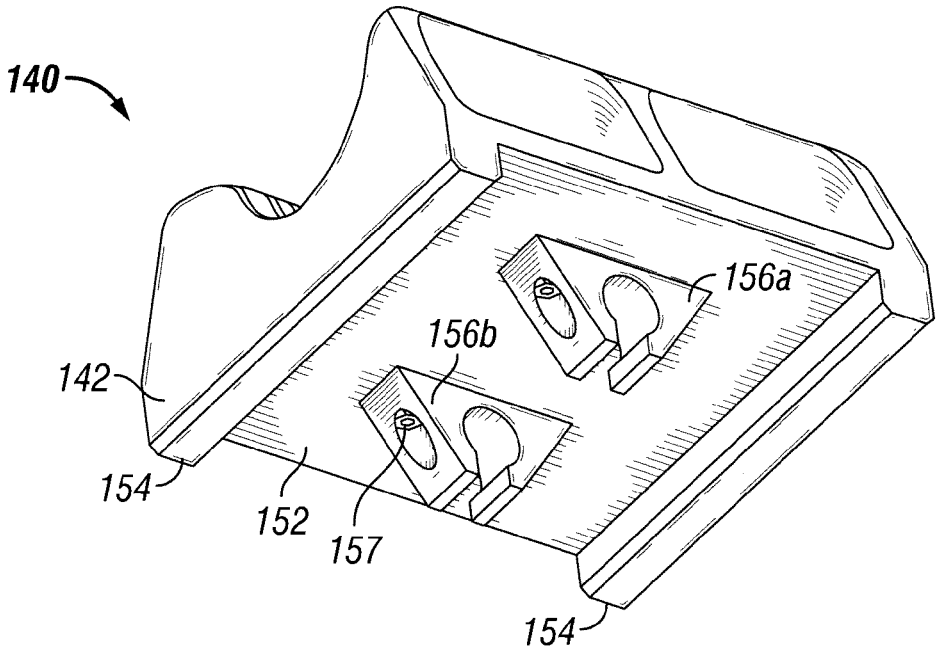
FIGS. 5C-D illustrate a gripping insert of the gripping insert assembly shown in FIGS. 3A-D.
Figure 5D:
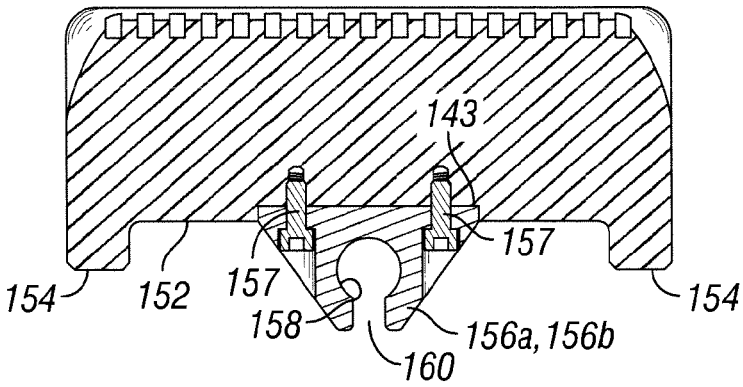

FIGS. 5C-D illustrate a gripping insert 140 having tongue portions 156*a*, 156*b* which are attached or coupled to the lower surface 152 of the gripping insert 140. Tongue portions 156*a*, 156*b* fit within a recess 143 machined or otherwise formed in the lower surface 152 of the gripping insert 140. One or more threaded fasteners 157 may be used to secure the tongue portions 156*a*, 156*b* to the gripping insert 140.

Referring to FIGS. 5A-D, the tongue portions 156*a*, 156*b* have a centrally located first cutout 158. In certain embodiments, the first cutout may be circular. Alternatively, the first cutout may be polygonal or non-circular. The first cutout 158 has a diameter that is substantially equal to a diameter of the passageway 128 through the carrier block 110. The tongue portions 156*a*, 156*b* further include a peripheral cutout 160 that extends from the first cutout 158 to a distal end or edge of the tongue portions 156*a*, 156*b*. The peripheral cutout 160 has a width that is less than a diameter of the first cutout 158.

Figure 6:
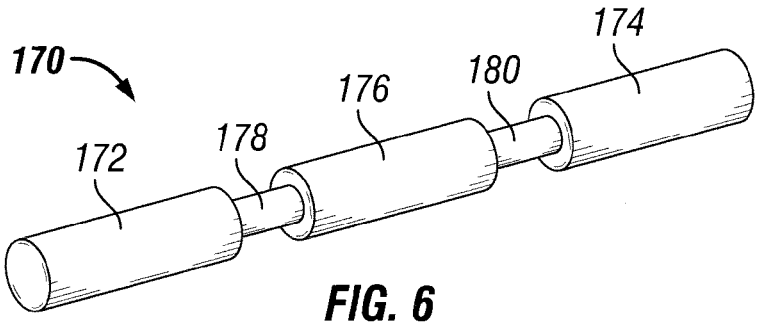
FIG. 6 illustrates a shaft of the gripping insert assembly shown in FIGS. 3A-D.

Referring now to FIG. 6, a perspective view of a shaft 170 in accordance with one or more embodiments of the present disclosure is shown. The shaft 170 may be a circular rod that is arranged and designed to be inserted into the passageway 128 extending longitudinally through the carrier block 110. Alternatively, the shaft may have a polygonal or non-circular cross-section. A cross-sectional geometry of the shaft should correspond to a cross-sectional geometry of passageway 128 (FIGS. 4A-B) and first cutout 158 (FIGS. 5A-D). The shaft 170 may be solid or hollow longitudinally there through. A first end portion 172, a second end portion 174, and a central portion 176 of the shaft 170 have a first diameter, which substantially corresponds with an outer diameter of the passageway 128 extending longitudinally through the carrier block 110, and an outer diameter of the first cutout 158 in the extruded tongue portions 156*a*, 156*b* of the gripping insert 140. A first intermediate portion 178 and a second intermediate portion 180 of the shaft 170 have a second diameter, which substantially corresponds with a dimension of the peripheral cutout 160 of the extruded tongue portions 156*a*, 156*b* of the gripping insert 140. The second diameter is less than the first diameter.

Figure 7A:
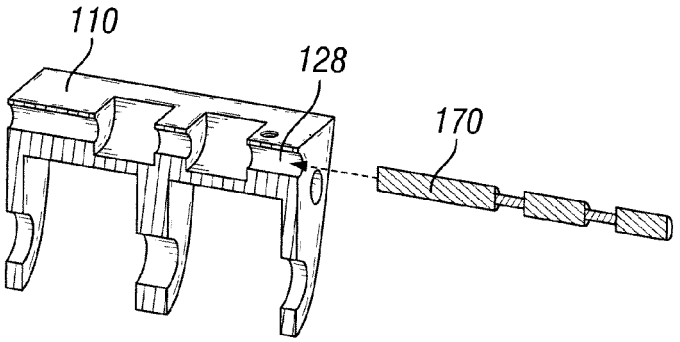
FIGS. 7A-C illustrate steps in assembling the shaft in the carrier block of the gripping insert assembly shown in FIGS. 3A-D.
Figure 7B:
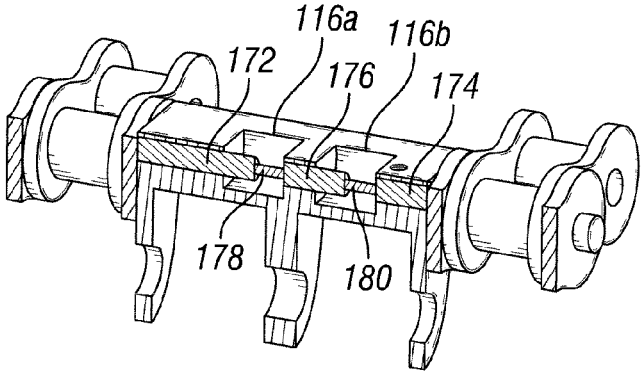

Referring to FIGS. 6 and 7B, in certain embodiments, when the shaft 170 is inserted within the passageway 128 of the carrier block 110, a first end portion 172 of the shaft 170 extends longitudinally within the passageway 128 from a first end of the carrier block 110 to substantially the center of the first pocket 116*a*. In other embodiments, the first end portion may extend longitudinally within one-quarter length of the pocket, or within three-quarters length of the pocket, or other pocket lengths.

A central portion 176 of the shaft 170 extends longitudinally within the passageway 128 in the divider wall 118 from a second end of the first pocket 116*a* to substantially the center of the second pocket 116*b*. In other embodiments, the central portion may extend longitudinally within one-quarter length of the pocket, or within three-quarters length of the pocket, or other pocket lengths.

A second end portion 174 of the shaft 170 extends longitudinally within the passageway 128 from a second end of the second pocket 116*b* to a second end of the carrier block 110. A first intermediate portion 178 of the shaft 170 extends from substantially the center of the first pocket 116*a* to the second end of the first pocket 116*a* (i.e., where divider wall 118 begins). A second intermediate portion 180 of the shaft 170 extends from substantially the center of the second pocket 116*b* to the second end of the second pocket 116*b*. As shown, the first intermediate portion 178 and the second intermediate portion 180 of the shaft 170 extend longitudinally only within the first and second pockets 116*a*, 116*b*, respectively. That is, an interface between said first and second diameters is longitudinally disposed within said pocket.

Figure 3A:
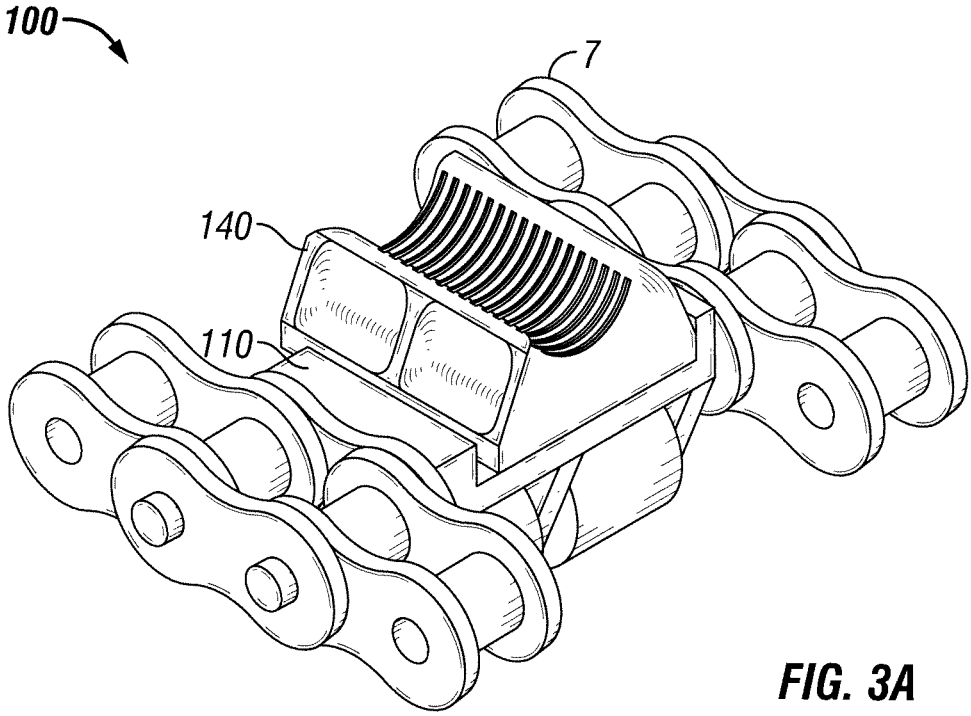
FIGS. 3A-D illustrate a gripping insert assembly in accordance with one or more embodiments of the present disclosure.
Figure 3B:
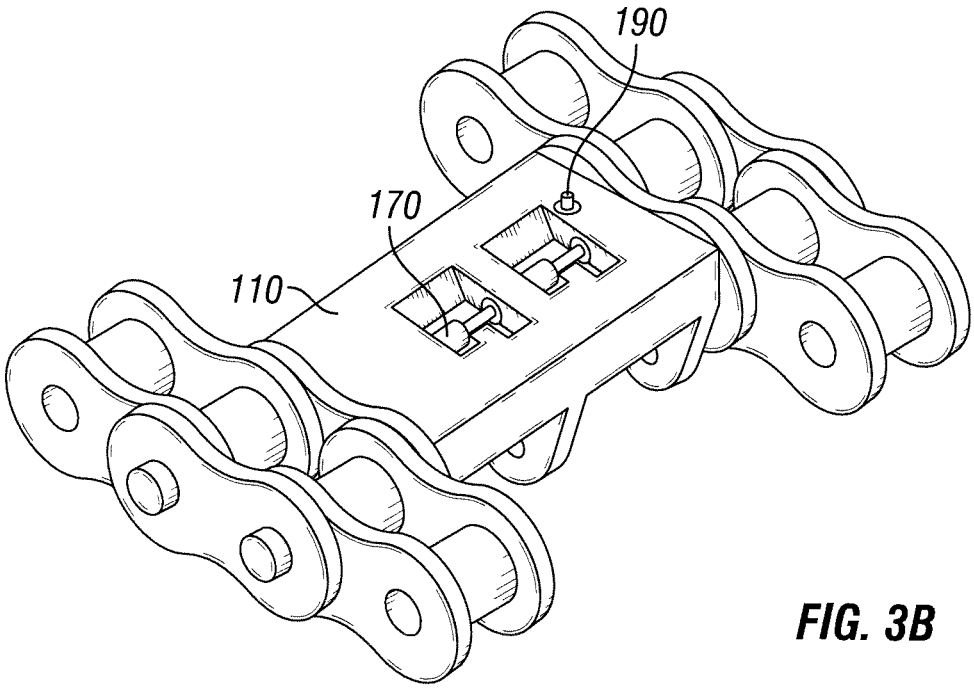
Figure 3C:
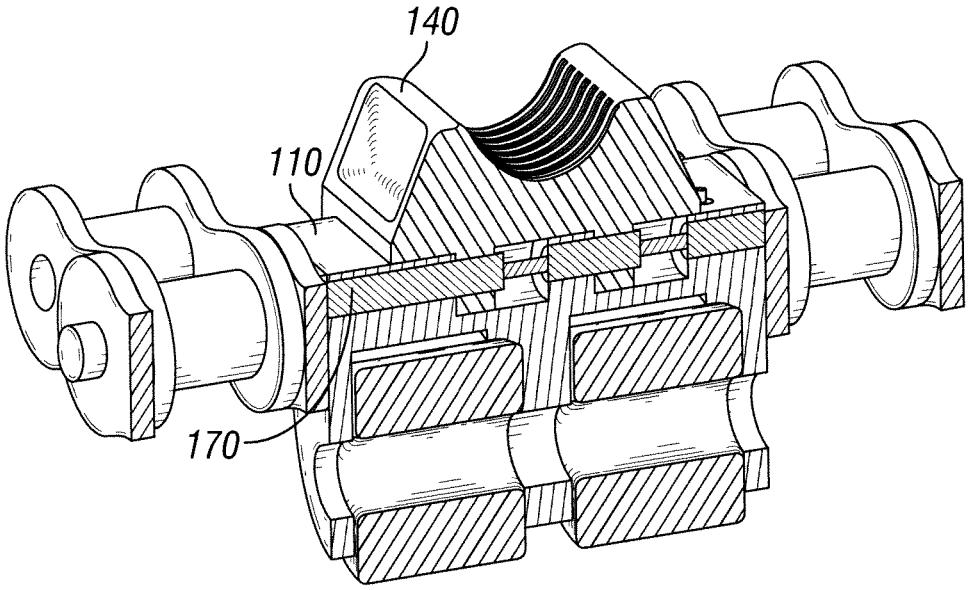
Figure 3D:
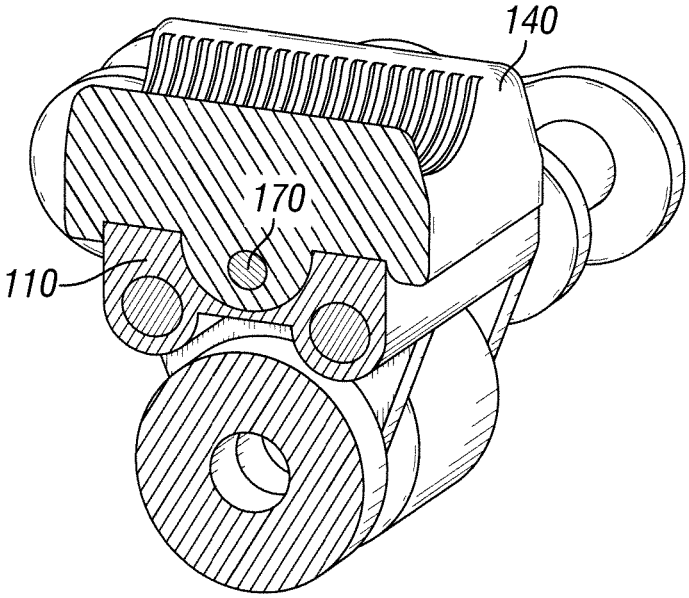
Figure 7C:
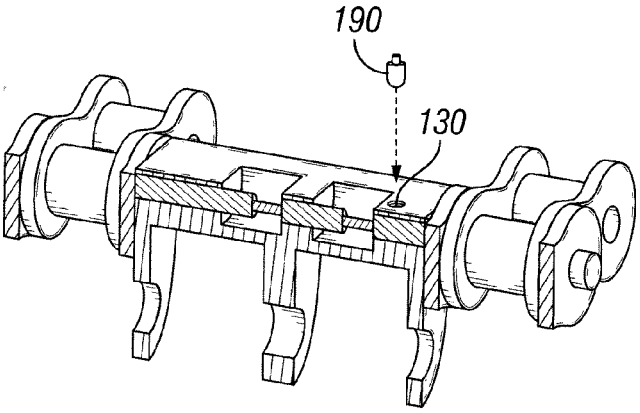

As shown in FIGS. 3B and 7C, the spring plunger 190 is a commonly used spring-loaded device that will be known to one of ordinary skill in the art. The spring plunger 190 includes a hollow cylindrical body with external threads that engage internal threads of the port 130 in the planar upper surface of the carrier block. A plunger member is disposed within the hollow cylindrical body along with a spring (of any kind), which biases the plunger within the hollow cylindrical body in one direction, so that an end or tip of the plunger member extends beyond the cylindrical body. Accordingly, the plunger member may be depressed (against the spring) so that the end of the plunger member is longitudinally aligned with an end of the cylindrical body. When released, the end of the plunger member extends longitudinally past the end of the cylindrical body.

In one aspect, embodiments disclosed herein relate to a gripping insert assembly used in a coiled tubing injector unit including a carrier block having an upper surface, at least one pocket formed in said upper surface, and a passageway substantially latitudinally centered and extending longitudinally there through, a shaft corresponding to a cross-section of said passageway of said carrier block, said shaft including at least a first end portion and a central portion having a first shaft diameter, and an intermediate portion having a second shaft diameter, wherein said first shaft end portion extends longitudinally within said pocket, and wherein said intermediate shaft portion extends longitudinally within said pocket, and a gripping insert having at least one tongue portion corresponding to said pocket in said upper surface of said carrier block, wherein said tongue portion comprises a first cutout substantially corresponding to said first shaft diameter, and a second cutout substantially corresponding to said second shaft diameter.

Methods of assembling the gripping insert and the carrier block is a two-step process: first the shaft is installed into the carrier block (shown in FIGS. 7A-C), then the gripping insert is coupled with the carrier block (shown in FIGS. 8A-D). Referring to FIGS. 7A-C), the shaft 170 is inserted into the passageway 128 of the carrier block 110 so that ends of the shaft 170 are flush with ends of the carrier block 110 (FIG. 7A). The carrier block 110 is then installed between the drive chains 102 (FIG. 7B). Next, the spring plunger 190 is installed into the port 130 in the planar upper surface of the carrier block 110 (FIG. 7C). The plunger 190 may be threaded, or alternatively may be press fit or otherwise within the port 130.

Figure 8A:
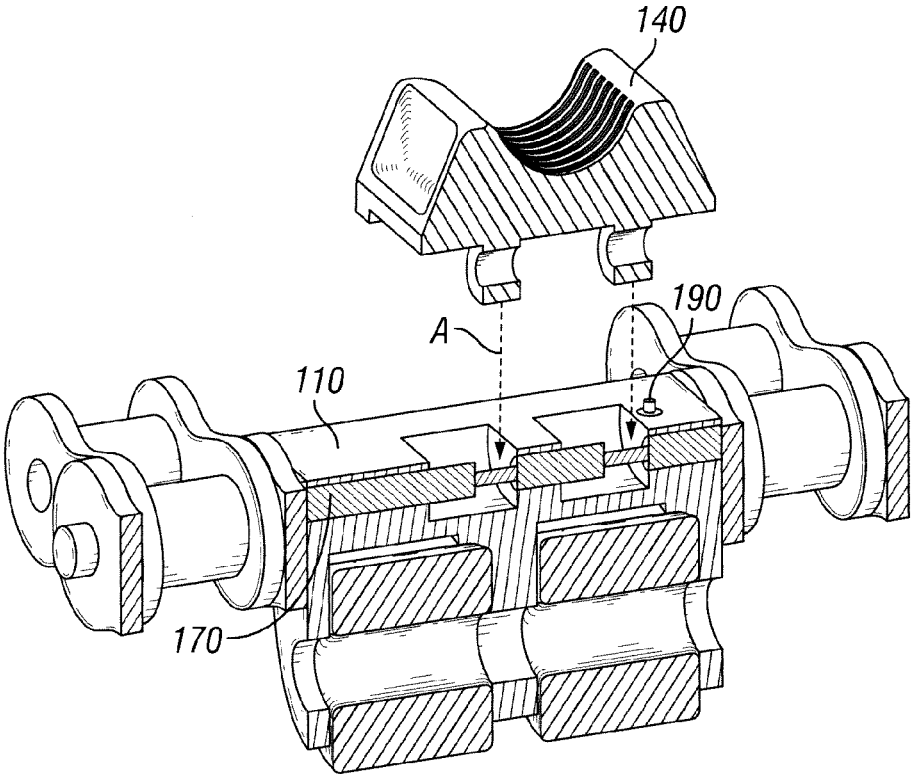
FIGS. 8A-D illustrate steps in assembling the gripping insert and carrier block of the gripping insert assembly shown in FIGS. 3A-D.

Referring to FIGS. 8A-D, to couple the gripping insert 140 with the carrier block 110, extruded tongue portions of the gripping insert 140 are longitudinally aligned with pockets of the carrier block 110, and more particularly with first and second intermediate portions of the shaft 170 that extend longitudinally within pockets (i.e., intermediate portions having the smaller diameter). Extruded tongues of the gripping insert 140 are vertically inserted (as indicated by arrow A) into the pockets of the carrier block 110 until the planar bottom surface of the gripping insert 140 contacts and sits flush with the planar upper surface of the carrier block 110 (FIG. 8A). Lips 154 (FIGS. 5A-B) extend downward past the planar upper surface of the carrier block and provide alignment and indication that the gripping insert 140 is properly engaged with the carrier block 110. The planar bottom surface of the gripping insert 140 also depresses the spring plunger 190 flush with the planar upper surface of the carrier block 110. During vertical installation of the gripping insert 140, the peripheral cutouts in the extruded tongues initially engage the first and second intermediate portions of the shaft 170. Subsequently, when the planar bottom surface of the gripping insert 140 contacts the planar upper surface of the carrier block 110, the first and second intermediate portions of the shaft 170 are concentrically positioned within the circular cutouts (having a first diameter) of the extruded tongues.

Figure 8B:
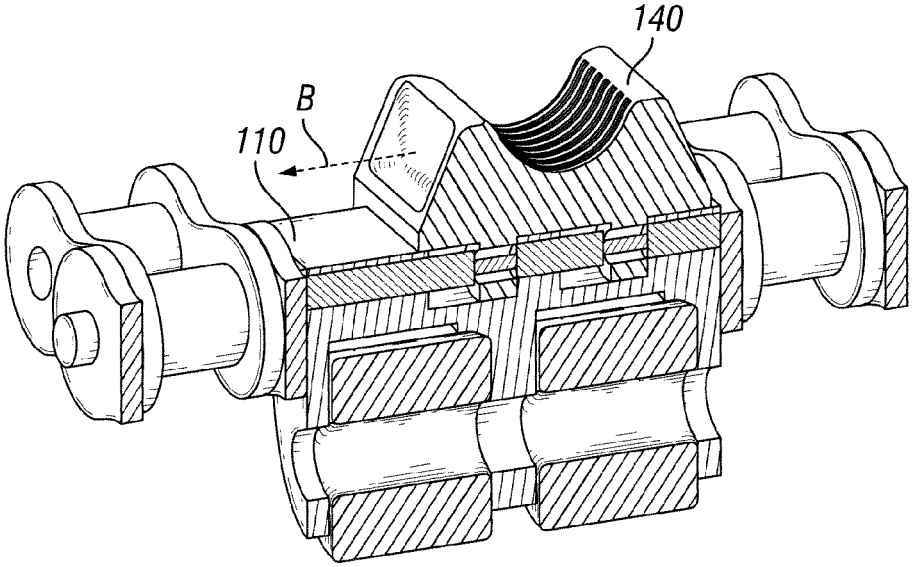

The gripping insert 140 is then horizontally moved (indicated by arrow B) to engage the circular cutouts of the extruded tongue portions with the first end portion and central end portion (both having a first diameter) of the shaft 170 extending within the pockets (FIG. 8B). Engagement of the circular cutouts with the first diameter portions of the shaft 170 precludes vertical movement of the gripping insert (indicated by arrow A). The gripping insert 140 is slid horizontally until the extruded tongues contact end surfaces of the first and second pockets, at which point a full width of the extruded tongues is engaged with the first diameter portions of the shaft 170 within the pockets.

Figure 8C:
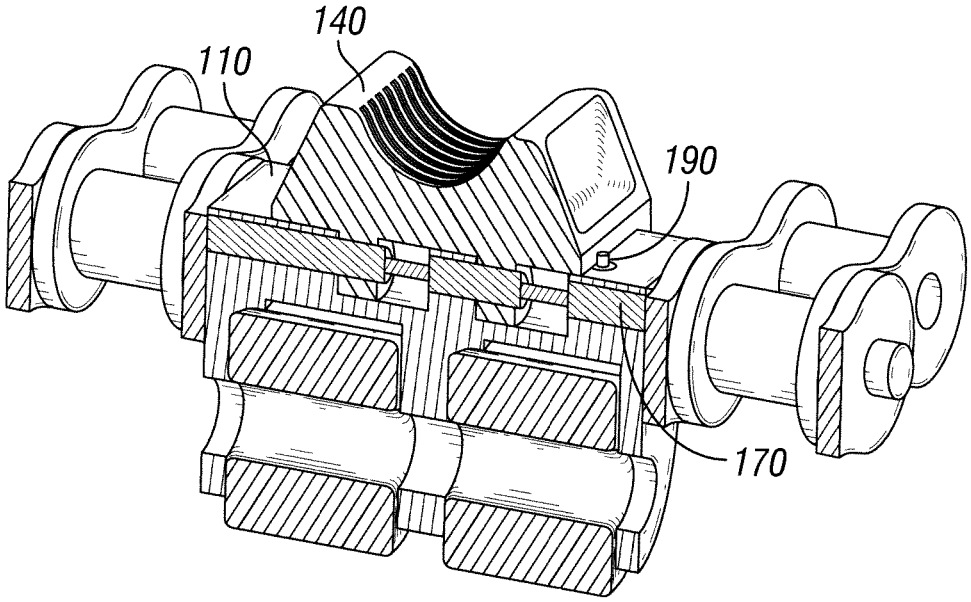
Figure 8D:
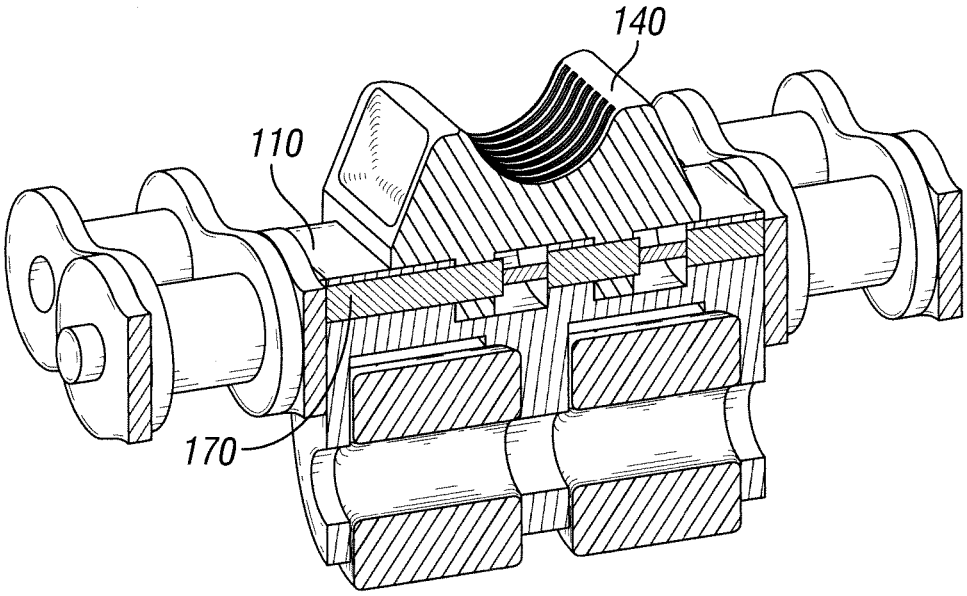

Also, spring plunger 190, which was depressed within the port by the planar lower surface of the gripping insert 140, is biased upward and locks the gripping insert 140 in place (FIG. 8C-D). Particularly, an end of the plunger member is biased upward by the internal spring to a position above the planar upper surface of the carrier block 110, which prevents the gripping insert from moving in a horizontal direction (indicated by arrow B).

Quick disassembly of decoupling of the gripping insert 140 from the carrier block 110 proceeds in a manner opposite of assembly. The spring plunger 190 is depressed to allow the gripping insert 140 to slide horizontally (opposite of the direction indicated by arrow B) to move the circular cutouts in extruded tongues into longitudinal alignment over the first and second intermediate portions of the shaft 170. Then, the gripping insert 140 is lifted vertically (opposite the direction indicated by arrow A) to allow second cutouts of the extruded tongues to pass over and disengage from the first and second intermediate portions of the shaft 170.

In certain aspects, embodiments disclosed herein relate to a method of assembling a gripping insert assembly including providing said gripping insert assembly including a carrier block having an upper surface, one or more pockets formed in said upper surface, and a passageway latitudinally centered and extending longitudinally there through, a shaft arranged and designed to be inserted within said passageway of said carrier block, said shaft including a first end portion, a second end portion, and central portion having a first shaft diameter, and a first intermediate portion and a second intermediate portion having a second shaft diameter, and a gripping insert having a lower surface and one or more tongue portions corresponding to said one or more pockets in said upper surface of said carrier block, wherein said tongue portions include a circular cutout corresponding with said first shaft diameter, and a peripheral cutout corresponding with said second shaft diameter. The method further includes inserting the shaft within said passageway of said carrier block, wherein said first shaft end portion and first intermediate shaft portion extend longitudinally within said pocket, and wherein said central shaft portion and second intermediate shaft portion extend longitudinally within said pocket, inserting said tongue portions of said gripping insert into said pockets of said carrier block until said lower surface of said gripping insert contacts and sits flush with said upper surface of said carrier block, wherein said tongue portions engage said first and second intermediate shaft portions, and sliding said gripping insert horizontally until said tongue portions are longitudinally aligned with said first shaft end portion and central portions.

Advantageously, embodiments disclosed herein for quick-release gripping inserts reduces time required to replace the gripping inserts in a number of situations. For example, gripping inserts may be replaced to use different sizes of coiled tubing based on particular applications. Additionally, gripping inserts may need to be replaced due to wear or damage. Accordingly, rig downtime due to maintenance or replacement of gripping inserts is greatly reduced, which in turn reduces costs and increases productivity of the coiled tubing operation.

The claimed subject matter is not to be limited in scope by the specific embodiments described herein. Indeed, various modifications of the invention in addition to those described herein will become apparent to those skilled in the art from the foregoing description. Such modifications are intended to fall within the scope of the appended claims.

What is claimed is:

1. A coiled tubing injector unit insert assembly comprising:

a carrier block having a carrier block pocket;

a shaft extending through the carrier block pocket, the shaft having a first diameter portion and a second larger diameter portion, and a junction between the two shaft diameters that is located within the carrier block pocket; and a gripping insert having a tongue, the tongue comprising at least a first cutout configured to engage the shaft extending through the carrier block pocket and couple the gripping insert to the carrier block, and a peripheral cutout having a width less than the diameter of the first cutout.

2. The insert assembly of claim 1, wherein the gripping insert is configured to slide longitudinally with respect to the carrier block to couple the gripping insert to the carrier block.

3. The insert assembly of claim 1, wherein the peripheral cutout transitions to the larger first cutout.

4. The insert assembly of claim 1, wherein the first cutout is substantially the same size as the second larger shaft diameter portion.

5. The insert assembly of claim 1, further comprising a depressible biased mechanism in the carrier block for restricting movement of the gripping insert relative to the carrier block.

6. The insert assembly of claim 1, wherein the shaft is removable from the carrier block.

7. The insert assembly of claim 1, wherein the shaft is disposable within a passageway extending longitudinally through the carrier block.

8. The insert assembly of claim 1, wherein the carrier block pocket comprises a curved lower surface.

9. The insert assembly of claim 1, wherein a longitudinal cross-sectional geometry of the gripping insert tongue substantially corresponds with a latitudinal cross-sectional geometry of the carrier block pocket.

10. The insert assembly of claim 1, wherein the junction between the two shaft diameters is substantially centered longitudinally with the carrier block pocket.

11. The insert assembly of claim 1, the tongue portion having the peripheral cutout substantially the same size as the smaller shaft diameter and the substantially central first cutout the same size as the larger shaft diameter.

12. The insert assembly of claim 1, wherein the tongue has a latitudinal thickness less than a longitudinal distance between end surfaces of the carrier block pocket.

13. A coiled tubing conveying apparatus comprising:

a pair of continuous parallel drive chains revolving in a common plane, said pair of continuous drive chains having opposed, elongated parallel runs spaced apart to form a path for engaging tubing passing there through; and a plurality of gripping insert assemblies carried on each of said pair of continuous drive chains, each comprising a gripping insert configured to be coupled to a carrier block, the insert comprising:

a tongue with a first cutout configured to engage a shaft extending within a carrier block pocket, wherein the shaft is configured having a first diameter portion and a second larger diameter portion substantially the same size as the first cutout, and a junction between the two shaft diameters that is located within the carrier block pocket to couple the gripping insert to the carrier block.

14. The insert assembly of claim 13, further comprising a depressible biased mechanism in the carrier block for restricting movement of the gripping insert relative to the carrier block.

15. The insert assembly of claim 13, wherein the junction between the two shaft diameters is substantially centered longitudinally with the carrier block pocket.

16. A method of assembling a coiled tubing injector unit insert assembly comprising:

providing a gripping insert configured to be coupled to a carrier block, the insert comprising a tongue with a first cutout configured to engage a shaft extending within a carrier block pocket, the shaft having a first diameter portion and a second larger diameter portion and a junction between the two shaft diameters that is located within the carrier block pocket to couple the gripping insert to the carrier block;

inserting the gripping insert tongue into the carrier block pocket until the first cutout is substantially concentrically aligned with the larger shaft diameter portion;

sliding the gripping insert in a first direction and causing the first cutout in the tongue to engage the larger shaft diameter portion, thereby coupling the gripping insert to the carrier block; and using a locking mechanism when the first cutout has engaged the larger shaft diameter portion, thereby restricting the gripping insert from sliding in a direction opposite the first direction.

17. The method of claim 16, further comprising installing the shaft within a passageway extending longitudinally within the carrier block.

18. The method of claim 16, further comprising substantially aligning, in the longitudinal direction relative to the carrier block, the gripping insert tongue with the first diameter shaft portion prior to inserting the tongue into the carrier block pocket.

* * * * *